US008250704B2

(12) United States Patent
Yoo

(10) Patent No.: US 8,250,704 B2
(45) Date of Patent: Aug. 28, 2012

(54) SUCTION NOZZLE ASSEMBLY AND VACUUM CLEANER HAVING THE SAME

(75) Inventor: Dong-hun Yoo, Gwangju (KR)

(73) Assignee: Samsung Electronics Co., Ltd., Gwangju-Si (KR)

( * ) Notice: Subject to any disclaimer, the term of this patent is extended or adjusted under 35 U.S.C. 154(b) by 581 days.

(21) Appl. No.: 12/583,034

(22) Filed: Aug. 13, 2009

(65) Prior Publication Data

US 2010/0107359 A1 May 6, 2010

(30) Foreign Application Priority Data

Nov. 3, 2008 (KR) ..... 10-2008-0108484

(51) Int. Cl.
*A47L 9/04* (2006.01)

(52) U.S. Cl. ..... 15/355; 15/356; 15/368; 15/373; 15/383

(58) Field of Classification Search ..... 15/354–356, 15/365, 368, 369, 373, 383; *A47L 9/04, 9/06, A47L 5/34*

See application file for complete search history.

(56) References Cited

U.S. PATENT DOCUMENTS

| | | | |
|---|---|---|---|
| 4,499,628 | A | 2/1985 | Platt |
| 6,170,119 | B1 | 1/2001 | Conrad et al. |
| 2008/0109985 | A1 | 5/2008 | Park et al. |
| 2008/0172820 | A1 | 7/2008 | Yoo |

FOREIGN PATENT DOCUMENTS

| | | |
|---|---|---|
| DE | 202005019993 | 2/2006 |
| JP | 8243059 | 9/1996 |
| JP | 2002165731 | 6/2002 |
| JP | 2004141536 | 5/2004 |
| JP | 2008104627 | 5/2008 |
| WO | WO2005/074779 | 8/2005 |

OTHER PUBLICATIONS

Extended European Search Report for corresponding European Patent Application No. 09252319.0, Jan. 3, 2010.

*Primary Examiner* — David Redding

(74) *Attorney, Agent, or Firm* — Ohlandt, Greeley, Ruggiero & Perle, LLP

(57) ABSTRACT

A suction nozzle assembly for a vacuum cleaner is provided. The suction nozzle assembly includes a suction nozzle assembly body, a hair collecting unit that is disposed on the suction nozzle assembly body, and an elevating unit for raising and lowering the hair collecting unit, wherein if the front of the suction nozzle assembly body contacts a wall, the elevating unit raises the hair collecting unit, and if the suction nozzle assembly body is separated from the wall, the elevating unit lowers down the hair collecting unit to a previous position.

20 Claims, 7 Drawing Sheets

SUCTION NOZZLE ASSEMBLY AND VACUUM CLEANER HAVING THE SAME

CROSS-REFERENCE TO RELATED APPLICATIONS

This application claims benefit under 35 U.S.C. §119(a) from Korean Patent Application No. 10-2008-0108484, filed on Nov. 3, 2008, in the Korean Intellectual Property Office, the disclosure of which is incorporated herein by reference in its entirety.

BACKGROUND OF THE INVENTION

1. Field of the Invention

The present disclosure relates to a vacuum cleaner, and more particularly, to a suction nozzle assembly having improved function for cleaning corners.

2. Description of the Related Art

General vacuum cleaners include a cleaner body having a vacuum suction apparatus and a dust separating apparatus, and a suction nozzle assembly connected to the cleaner body. The suction nozzle assembly draws in dust-laden air using negative pressure generated by the vacuum suction apparatus, and the dust separating apparatus separates the dirt or dust.

The suction nozzle assembly may include an agitator brush so that the vacuum cleaner may be frequently used to clean a surface such as a carpet or rug. An agitator brush having a plurality of bristles around the periphery thereof agitates the surface being cleaned while rotating, and thus dirt or dust can be detached from the surface. Accordingly, the agitator brush may make it easier for a user to clean the carpet.

Recently, pets have increasingly come to be raised indoors, and thus animal or human hair may become tangled and piled up on a surface such as a carpet or rug. Since operation of the agitator brush alone cannot detach animal or human hair (hereinafter referred to as "fibrous contaminants") from the surface, the animal or human hair may not be able to be drawn into the suction nozzle assembly. If the animal or human hair becomes excessively tangled on the agitator brush, the agitator brush cannot normally agitate the surface being cleaned. The tangled hair may block the passage through which dirt or dust is drawn in, and accordingly, the suction force of the agitator brush may be weakened.

In order to resolve the above problems, apparatuses such as a pet brush to remove animal's hair may be additionally attached to the suction nozzle assembly. In this situation, if the pet brush contacts the wall, the vacuum to draw in dirt or dust is not applied to an area adjacent to the wall and accordingly dirt or dust does not get drawn in.

SUMMARY OF THE INVENTION

Exemplary embodiments of the present disclosure address at least the above problems and/or disadvantages and other disadvantages not described above. Also, the present disclosure is not required to overcome the disadvantages described above, and an exemplary embodiment of the present disclosure may not overcome any of the problems described above.

The present disclosure provides a suction nozzle assembly in which long and thin dirt or debris such as human or animal hair, or waste threads (hereinafter referred to as "fibrous contaminants") is efficiently removed from a surface being cleaned, and cleaning efficiency is enhanced on an area such as a corner adjacent to a wall, and a vacuum cleaner having the same.

According to an exemplary aspect of the present disclosure, there is provided a suction nozzle assembly usable with a vacuum cleaner, including a suction nozzle assembly body; a hair collecting unit that is disposed on the suction nozzle assembly body; and an elevating unit for raising and lowering the hair collecting unit, wherein if the front of the suction nozzle assembly body contacts a wall, the elevating unit raises the hair collecting unit, and if the suction nozzle assembly body is separated from the wall, the elevating unit lowers down the hair collecting unit to a previous position.

The elevating unit may select one of raising by a vertical movement and raising by a rotational movement in order to adjust the height of the hair collecting unit.

The elevating unit may include a pivot lever that is mounted on the front part of the suction nozzle assembly body, and is hingeably rotated by the blocking of a wall; and a supporting device one end of that is connected to the pivot lever and another end of that is connected to the hair collecting unit, and raises and lowers the hair collecting unit in association with the rotational movement of the pivot lever.

The supporting device may include a supporting holder that rotatably supports both ends of the hair collecting unit; and an elevating pin one end of which is connected to the supporting holder and another end of which is connected to the pivot lever.

The supporting holder may include a latch unit that restrains a rotational direction of the hair collecting unit.

An elastic member for pressing the hair collecting unit to contact the surface being cleaned may be interposed between the supporting device and an inner surface of the suction nozzle assembly body.

The hair collecting unit may include a hair collecting member having a plurality of protrusions that forms an acute angle with the surface being cleaned so that if the suction nozzle assembly body moves forward, the plurality of protrusions slide on a surface being cleaned, and if the suction nozzle assembly body moves backward, the plurality of protrusions cause friction against the surface being cleaned so as to detach fibrous contaminants.

According to another exemplary aspect of the present disclosure, there is provided a suction nozzle assembly usable with a vacuum cleaner, including a suction nozzle assembly body that comprises a suction passage; a hair collecting drum that is disposed on the suction nozzle assembly body and eliminates human or animal hair; a pivot brush that is rotatably mounted on the rear part of the hair collecting drum; and an elevating unit for raising and lowering the hair collecting drum, wherein if a front of the suction nozzle assembly body contacts a wall, the elevating unit raises the hair collecting unit, and if the suction nozzle assembly body is separated from the wall, the elevating unit lowers the hair collecting unit to a previous position.

The elevating unit may include a pivot lever that is mounted on the front part of the suction nozzle assembly body, and is hingeably rotated by the blocking of the wall; a supporting device for the hair collecting drum that supports both ends of the hair collecting drum, wherein an end is connected to the pivot lever and another end is connected to the hair collecting drum so as to raise and lower the hair collecting drum in association with the rotational movement of the pivot lever; and an elastic member that is interposed between the supporting device and an inner surface of the suction nozzle assembly body so as to press the supporting device towards the surface being cleaned.

The supporting device may include a latch pole that is hinged with the supporting holder for supporting both ends of the hair collecting drum, and blocks the rotational movement of the hair collecting drum; and a latch wheel that is formed inside the supporting holder to correspond to the latch pole and is engaged with the latch pole so that the hair collecting drum rotates in one direction.

According to another exemplary aspect of the present disclosure, there is provided a vacuum cleaner, including a vacuum cleaner body; and a suction nozzle assembly that is connected to the vacuum cleaner body and draws in dust-laden air from a surface being cleaned, wherein the suction nozzle assembly includes a suction nozzle assembly body; a hair collecting unit that is mounted to the suction nozzle assembly body; and an elevating unit for raising and lowering the hair collecting unit, wherein if a front of the suction nozzle assembly body contacts a wall, the elevating unit raises the hair collecting unit, and if the suction nozzle assembly body is separated from the wall, the elevating unit lowers the hair collecting unit to a previous position.

The elevating unit may select one of raising by a vertical movement and raising by a rotational movement in order to adjust the height of the hair collecting unit.

The elevating unit may include a pivot lever that is mounted on a front part of the suction nozzle assembly body, and is hingeably rotated by the blocking of a wall; and a supporting device one end of which is connected to the pivot lever and another end of which is connected to the hair collecting unit, and raises and lowers the hair collecting unit in association with the rotational movement of the pivot lever.

The supporting device may include a supporting holder that rotatably supports both ends of the hair collecting unit; and an elevating pin one end of which is connected to the supporting holder and another end of which is connected to the pivot lever.

The supporting holder may further include a latch unit that blocks the rotational direction of the hair collecting unit.

An elastic member for pressing the hair collecting unit to contact the surface being cleaned may be interposed between the supporting device and an inner surface of the suction nozzle assembly body.

The hair collecting unit may include a hair collecting member having a plurality of protrusions that forms an acute angle with the surface being cleaned so that if the suction nozzle assembly body moves forward, the plurality of protrusions slide on the surface being cleaned, and if the suction nozzle assembly body moves backward, the plurality of protrusions cause friction against the surface being cleaned so as to detach fibrous contaminants.

According to another exemplary aspect of the present disclosure, there is provided a vacuum cleaner, including a vacuum cleaner body; and a suction nozzle assembly that is connected to the vacuum cleaner body and draws in dust-laden air from a surface being cleaned, wherein the suction nozzle assembly includes a suction nozzle assembly body that comprises a suction passage; a hair collecting drum that is disposed on the suction nozzle assembly body and eliminates human or animal hair; and a pivot brush that is rotatably mounted on the rear part of the hair collecting drum; and an elevating unit for raising and lowering the hair collecting drum, wherein if the front of the suction nozzle assembly body contacts a wall, the elevating unit raises the hair collecting unit, and if the suction nozzle assembly body is separated from the wall, the elevating unit lowers the hair collecting unit to a previous position.

The elevating unit may include a pivot lever that is mounted on a front part of the suction nozzle assembly body, and is hingeably rotated by the blocking of the wall; a supporting device for the hair collecting drum that supports both ends of the hair collecting drum, wherein an end is connected to the pivot lever and another end is connected to the hair collecting drum so as to raise and lower the hair collecting drum in association with the rotational movement of the pivot lever; and an elastic member that is interposed between the supporting device and an inner surface of the suction nozzle assembly body so as to press the supporting device to contact the surface being cleaned.

The supporting device may include a latch pole that is hinged with the supporting holder for supporting both ends of the hair collecting drum, and restrains the rotational movement of the hair collecting drum; and a latch wheel that is formed inside the supporting holder to correspond to the latch pole and is engaged with the latch pole so that the hair collecting drum rotates in only one direction.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE INVENTION

Figure 1:
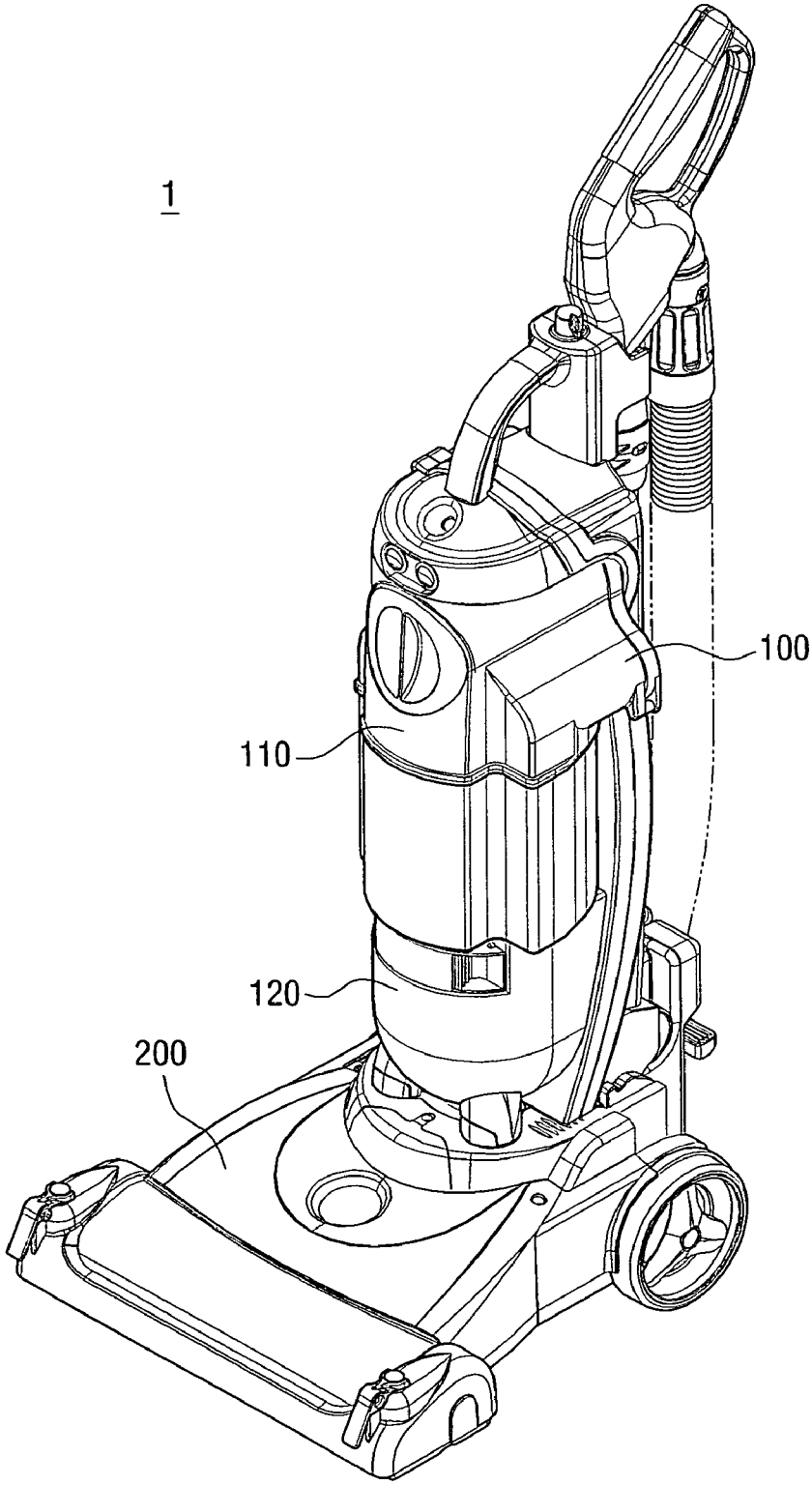
FIG. 1 is a perspective view of a vacuum cleaner according to an exemplary embodiment of the present disclosure.

Certain exemplary embodiments of the present disclosure will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the disclosure. Thus, it is apparent that the present disclosure can be carried out without those specifically defined matters. Also, well-known functions or constructions are not described in detail since they would obscure the disclosure with unnecessary detail.

FIG. 1 is a perspective view of a vacuum cleaner according to an exemplary embodiment of the present disclosure.

As shown in FIG. 1, a vacuum cleaner 1 according to an exemplary embodiment of the present disclosure includes a cleaner body 100 and a suction nozzle assembly 200.

The cleaner body 100 includes a dust separating apparatus 110 that separates dirt or dust from dust-laden air and a vacuum suction motor 120 that generates a vacuum.

The suction nozzle assembly 200 fluidly communicates with the cleaner body 100, draws in dirt or dust together with surrounding air from a surface being cleaned using the vacuum generated by the vacuum suction motor 120, and conveys the dirt or dust to the dust separating apparatus 110.

Figure 2:
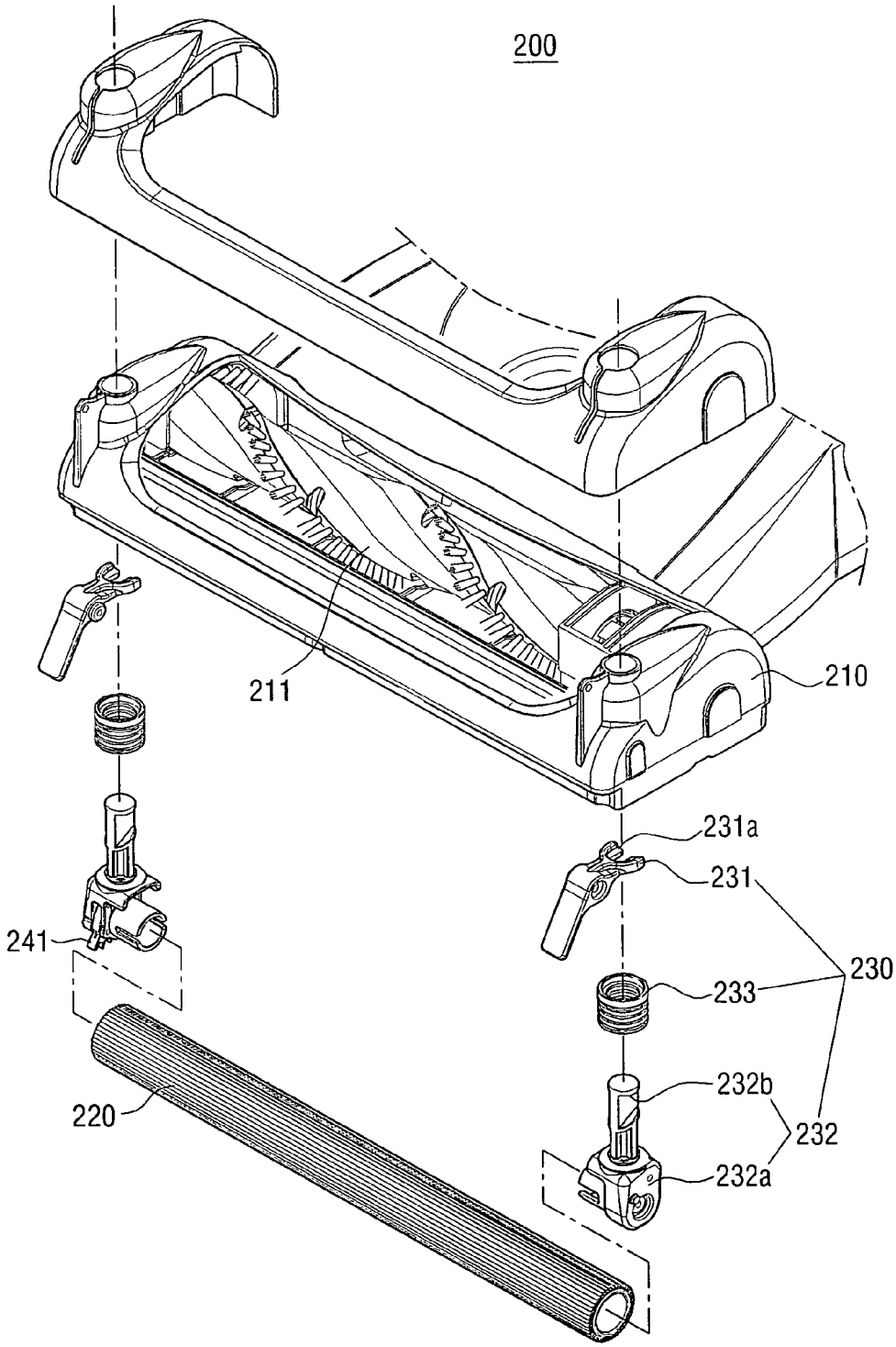
FIG. 2 is an exploded perspective view of a suction nozzle assembly of a vacuum cleaner according to an exemplary embodiment of the present disclosure.

As shown in FIG. 2, the suction nozzle assembly 200 according to an exemplary embodiment of the present disclosure includes a suction nozzle assembly body 210, a hair collecting unit 220, and an elevating unit 230 for raising and lowering the hair collecting unit 220.

The suction nozzle assembly body 210 includes therein an agitator brush 211 that is made to rotate by a driving source at high speed and agitates a surface being cleaned.

Figure 3:
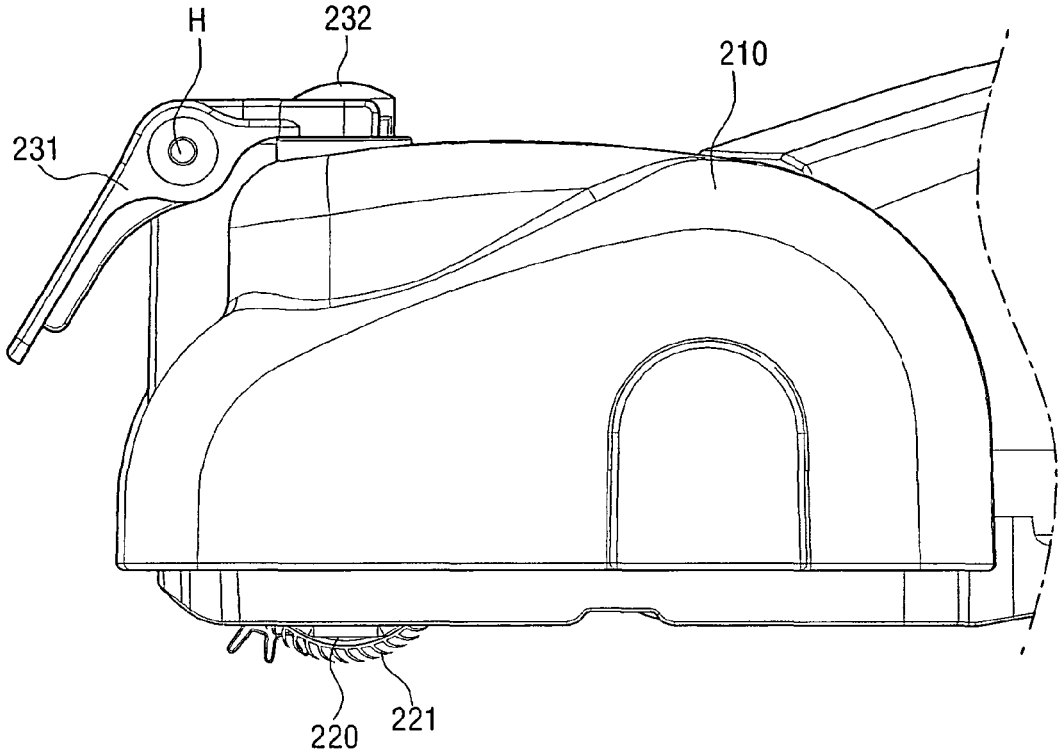
FIG. 3 is a side view of a suction nozzle assembly of a vacuum cleaner that is not in contact with a wall.
Figure 4:
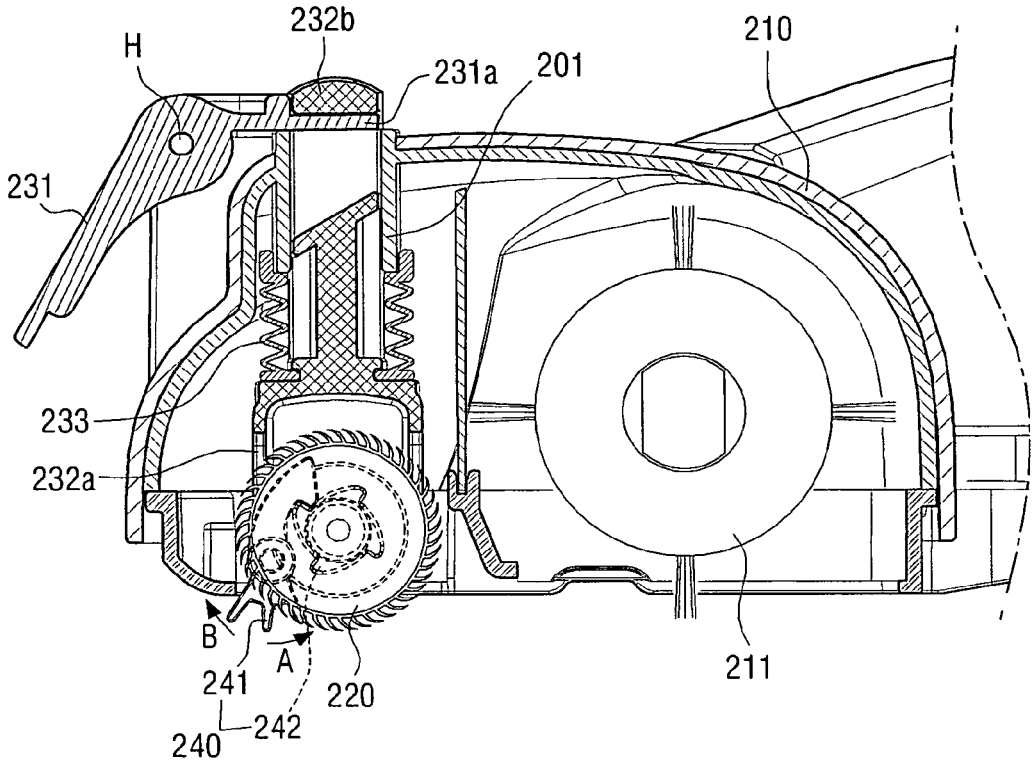
FIG. 4 is a side sectional view of a suction nozzle assembly of a vacuum cleaner that is not in contact with a wall.

The hair collecting unit 220 is mounted in front of the agitator brush 211, and eliminates human or animal hair, waste threads, or fibrous contaminants. The hair collecting unit 220 includes a plurality of protrusions 221 on the surface thereof as shown in FIGS. 3 and 4, and the plurality of protrusions 221 are inclined so as to form an acute angle with a surface being cleaned.

The hair collecting unit 220 may be configured in any form that includes a hair collecting member having the plurality of protrusions 221. For example, the hair collecting unit 220 may be formed as a floor cloth in which the hair collecting member is coupled on a plate, or as a drum in which the hair collecting member is mounted on a rotatable drum.

The elevating unit 230 causes the hair collecting unit 220 to be raised vertically or in a spiral manner in order to change the height of the hair collecting unit 220. According to an exemplary embodiment of the present disclosure, the elevating unit 230 is raised and lowered so as to change the height of the hair collecting unit 220.

The elevating unit 230 includes a pivot lever 231, a supporting device 232, and an elastic member 233.

The pivot lever 231 is mounted in front of the suction nozzle assembly body 210, and is made to hingeably rotate by the interference of the wall. A clasp 231*a* formed on an end of the pivot lever 231 is assembled to the supporting device 232.

The supporting device 232 includes a supporting holder 232*a* and an elevating pin 232*b*.

The supporting holder 232*a* rotatably supports both ends of the hair collecting unit 220 configured in a drum shape. The elevating pin 232*b* is associated with the clasp 231*a* and raises and lowers the supporting holder 232*a* in association with the rotational movement of the pivot lever 231.

Figure 6:
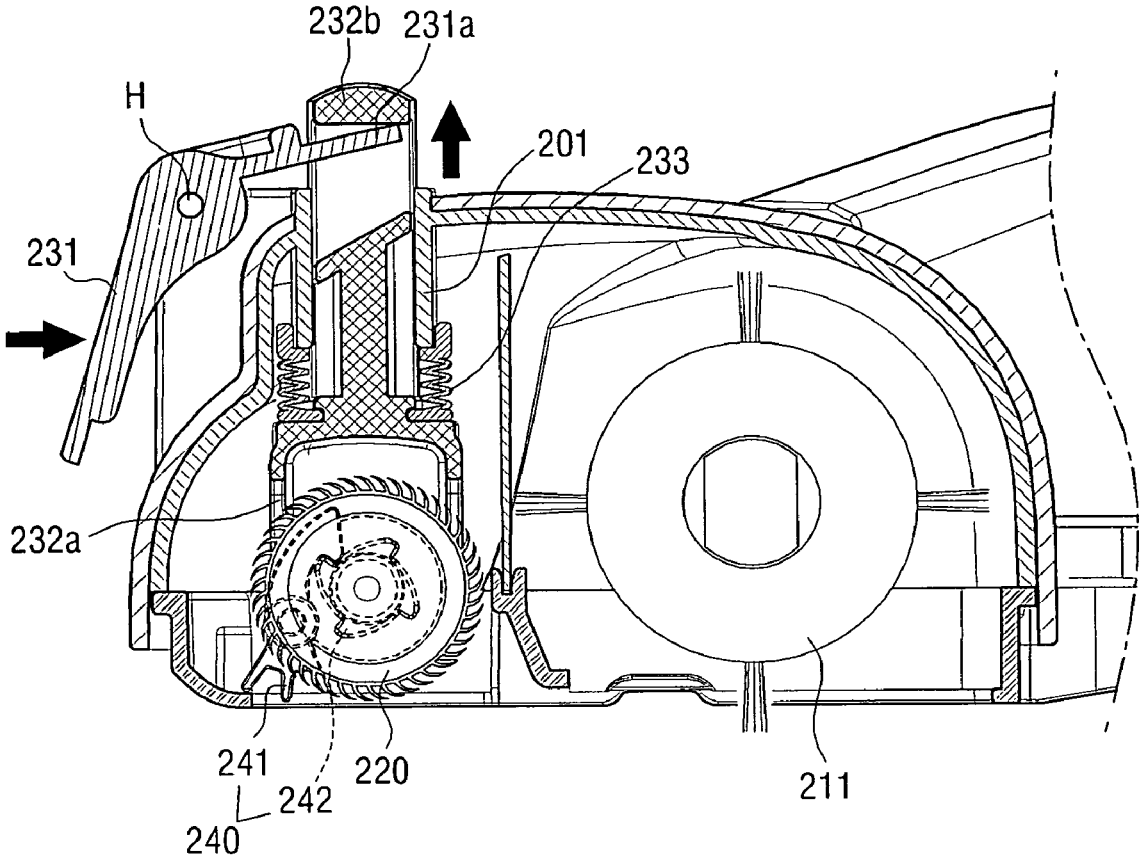
FIG. 6 is a side sectional view of a suction nozzle assembly of a vacuum cleaner that is in contact with a wall.

The supporting holder 232*a* may include a latch unit 240 that restrains the rotational direction of the hair collecting unit 220. The latch unit 240 may include a latch pole 241 and a latch wheel 242 as shown in FIGS. 4 and 6. When the suction nozzle assembly 200 moves backward, the latch unit 240 blocks the rotational movement of the hair collecting unit 220, and when the suction nozzle assembly 200 moves forward, the latch unit 240 permits the rotational movement of the hair collecting unit 220.

The elastic member 233 is provided between the supporting device 232 and the inner surface of the suction nozzle assembly body 210 and presses the hair collecting unit 220 towards a surface being cleaned. One end of the elastic member 233 may be supportably engaged with the elevating pin 232*b* and the other end be coupled with a recipient 201 inside the suction nozzle assembly body 210 as shown in FIG. 4.

The operation of the suction nozzle assembly according to an exemplary embodiment of the present disclosure will be explained with reference to FIGS. 3 to 6.

FIGS. 3 and 4 are a side view and a side sectional view of a suction nozzle assembly of a vacuum cleaner that is not in contact with a wall.

As shown in FIGS. 3 and 4, the hair collecting unit 220 having a drum brush shape is disposed in front of the agitator brush 211. If the suction nozzle assembly 200 moves forward, the latch pole 241 rotates in a direction indicated by arrow A and accordingly is unlocked from the latch wheel 242. Accordingly, the hair collecting unit 220 slides or rotates without causing friction against the surface being cleaned. If the suction nozzle assembly 200 moves backward, the latch pole 241 rotates in a direction indicated by arrow B and accordingly blocks the rotation of the hair collecting unit 220. Human or animal hair from the surface being cleaned is raked by the plurality of protrusions planted on the hair collecting unit 220, is collected in a space between the agitator brush 211 and the hair collecting unit 220. The collected human or animal hair is drawn into the dust separating apparatus 110 through the agitator brush 211.

On the surface being cleaned opposite the hair collecting unit 220 and the surface being cleaned corresponding to the front of the hair collecting unit 220, the vacuum does not exist or is not enough vacuum to draw in dirt or dust. This is because the hair collecting unit 220 blocks the suction passage. Since the cleaning operation is performed while the suction nozzle assembly 200 moves forward and backward, there is no problem to clean a general surface being cleaned. However, when the surface adjacent to the wall is cleaned, inconvenience may exist.

In order to solve the above problems, the suction nozzle assembly according to an exemplary embodiment of the present disclosure raises the hair collecting unit 220 when the suction nozzle assembly contacts the wall, and thus opens the suction passage.

Figure 5:
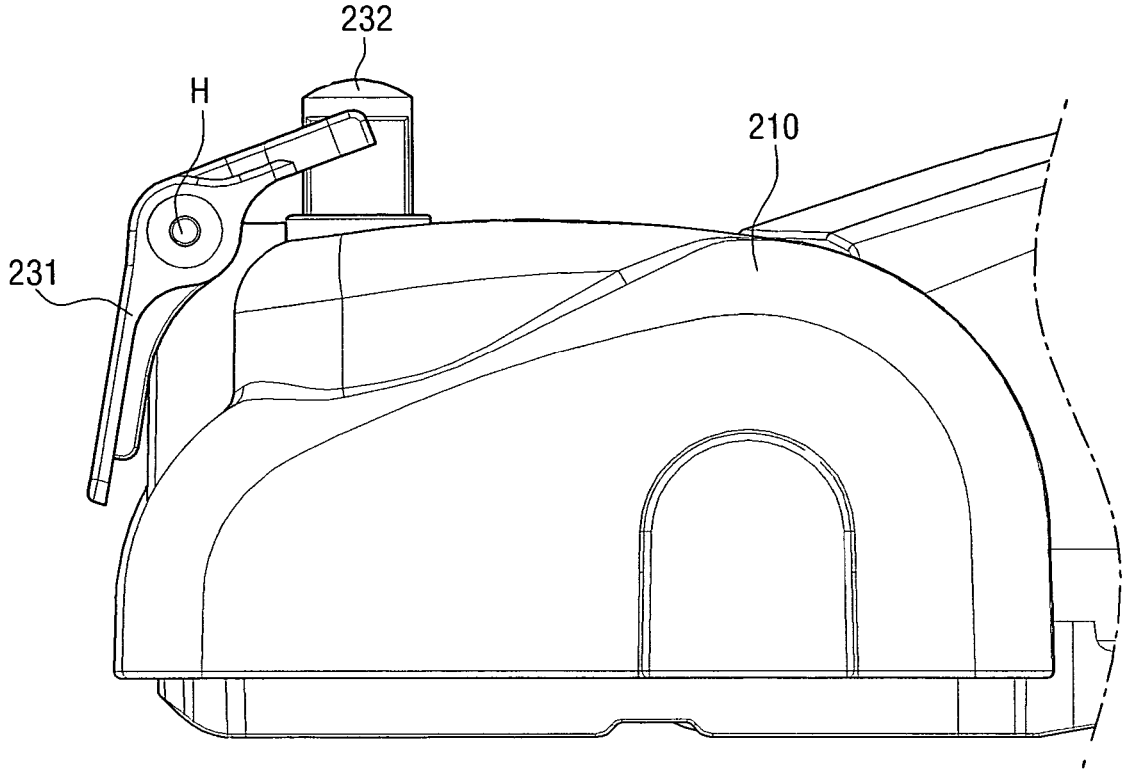
FIG. 5 is a side view of a suction nozzle assembly of a vacuum cleaner that is in contact with a wall.

If the suction nozzle assembly 200 contacts the wall, the pivot lever 231 pivots based on a hinge unit H as shown in FIGS. 5 and 6, and thus the clasp 231*a* of the pivot lever 231 raises the elevating pin 232*b*. The supporting holder 232*a* that is connected to the elevating pin 232*b* and supports both ends of the hair collecting unit 220 raises in association with the elevating pin 232*b*.

Since the hair collecting unit 220 is apart from the surface being cleaned at a specific height as shown in FIGS. 5 and 6, the vacuum may be transmitted from the opening of the suction nozzle assembly 200 to the opening in which the hair collecting unit 220 is disposed. Accordingly, it is possible to collect dirt or dust on the surface adjacent to the wall.

If the suction nozzle assembly 200 is apart from the wall, the pivot lever 231 returns to the state as shown in FIGS. 3 and 4 by the elastic resilience of the elastic member 233. Accordingly, the hair collecting unit 220 may normally operate.

According to an exemplary embodiment of the present disclosure, the elastic member 233 is disposed between the suction nozzle assembly body 210 and the elevating pin 232*b*. However, the elastic member 233 may not be mounted. However, even though the elastic member 233 is not provided, the elevating pin 232*b* may descend in the direction of gravity. Therefore, it is not difficult for the pivot lever 231 to return to its initial state.

Figure 7:
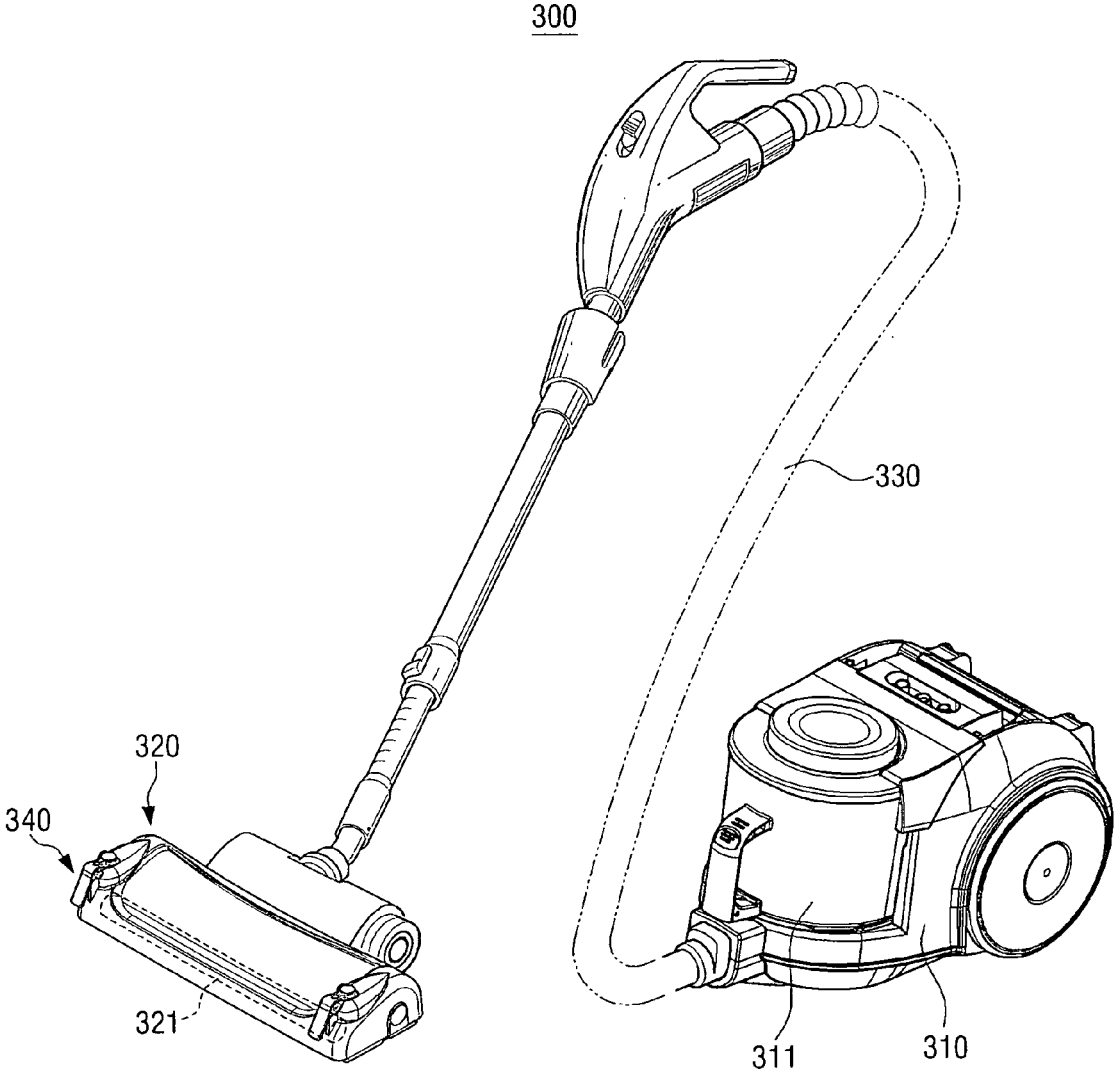
FIG. 7 is a perspective view of a canister vacuum cleaner according to another exemplary embodiment of the present disclosure.

FIG. 7 is a perspective view of a canister vacuum cleaner according to another exemplary embodiment of the present disclosure, in which the vacuum cleaner includes a suction nozzle assembly having a hair collecting unit.

As shown in FIG. 7, a canister vacuum cleaner 300 includes a vacuum suction motor (not shown), a cleaner body 310 having a dust separating apparatus 311, and a flexible hose 330 connecting a suction nozzle assembly 320 and the cleaner body 310.

The suction nozzle assembly 320 includes a hair collecting unit 321 to collect human or animal hair, or waste thread, and the hair collecting unit 321 is mounted in the front of the inside of the suction nozzle assembly 320. The hair collecting unit 321 is mounted so that an elevating unit 340 raises and lowers the hair collecting unit 321.

The elevating unit 340 operates with the blocking of the wall, and thus if the suction nozzle assembly 321 contacts the wall, the elevating unit 340 raises the hair collecting unit 320, and if the suction nozzle assembly 320 is separated from the wall, the elevating unit 340 lowers the hair collecting unit 321. The structure and operations of the elevating unit 340 are similar to those of the elevating unit 230 shown in FIGS. 1 to 6, and thus detailed description will be omitted.

The suction nozzle assembly employing the hair collecting unit having the raising and lowering function may also be applied to various types of vacuum cleaners in addition to the upright and canister vacuum cleaners.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A suction nozzle assembly usable with a vacuum cleaner, comprising:

a suction nozzle assembly body;

a hair collecting unit that is disposed on the suction nozzle assembly body; and an elevating unit for raising and lowering the hair collecting unit, wherein if a front of the suction nozzle assembly body contacts a wall, the elevating unit raises the hair collecting unit, and if the front of the suction nozzle assembly body is separated from the wall, the elevating unit lowers the hair collecting unit to a previous position.

2. The suction nozzle assembly as claimed in claim 1, wherein the elevating unit selects one of raising by a vertical movement and raising by a rotational movement in order to adjust the height of the hair collecting unit.

3. The suction nozzle assembly as claimed in claim 1, wherein the elevating unit comprises:

a pivot lever that is mounted on the front of the suction nozzle assembly body, and is hingeably rotated by the blocking of a wall; and a supporting device one end of which is connected to the pivot lever and another end of which is connected to the hair collecting unit, and raises and lowers the hair collecting unit in association with the rotational movement of the pivot lever.

4. The suction nozzle assembly as claimed in claim 3, wherein the supporting device comprises:

a supporting holder that rotatably supports both ends of the hair collecting unit; and an elevating pin one end of which is connected to the supporting holder and another end of which is connected to the pivot lever.

5. The suction nozzle assembly as claimed in claim 4, wherein the supporting holder comprises a latch unit that restrains a rotational direction of the hair collecting unit.

6. The suction nozzle assembly as claimed in claim 5, further comprising an elastic member for pressing the hair collecting unit to contact the surface being cleaned interposed between the supporting device and an inner surface of the suction nozzle assembly body.

7. The suction nozzle assembly as claimed in claim 6, wherein the hair collecting unit comprises a hair collecting member having a plurality of protrusions that forms an acute angle with the surface being cleaned so that if the suction nozzle assembly body moves forward, the plurality of protrusions slide on a surface being cleaned, and if the suction nozzle assembly body moves backward, the plurality of protrusions cause friction against the surface being cleaned so as to detach fibrous contaminants.

8. A suction nozzle assembly usable with a vacuum cleaner, comprising:

a suction nozzle assembly body that comprises a suction passage on a front part thereof;

a hair collecting drum that is disposed on the front part of the suction nozzle assembly body and eliminates human or animal hair;

a pivot brush that is rotatably mounted on a rear part of the hair collecting drum; and an elevating unit for raising and lowering the hair collecting drum, wherein if the front part of the suction nozzle assembly body contacts a wall, the elevating unit raises the hair collecting unit, and if the front part of the suction nozzle assembly body is separated from the wall, the elevating unit lowers the hair collecting unit to a previous position.

9. The suction nozzle assembly as claimed in claim 8, wherein the elevating unit comprises:

a pivot lever that is mounted on the front part of the suction nozzle assembly body, and is hingeably rotated by the blocking of the wall;

a supporting device for the hair collecting drum that supports both ends of the hair collecting drum, wherein an end is connected to the pivot lever and another end is connected to the hair collecting drum so as to raise and lower the hair collecting drum in association with the rotational movement of the pivot lever; and an elastic member that is interposed between the supporting device and an inner surface of the suction nozzle assembly body so as to press the supporting device to contact the surface being cleaned.

10. The suction nozzle assembly as claimed in claim 9, wherein the supporting device comprises:

a latch pole that is hinged with the supporting holder for supporting both ends of the hair collecting drum, and blocks the rotational movement of the hair collecting drum; and a latch wheel that is formed inside the supporting holder to correspond to the latch pole and is engaged with the latch pole so that the hair collecting drum rotates in only one direction.

11. A vacuum cleaner, comprising:

a vacuum cleaner body; and a suction nozzle assembly that is connected to the vacuum cleaner body and draws in dust-laden air from a surface being cleaned, wherein the suction nozzle assembly comprises:

a suction nozzle assembly body;

a hair collecting unit that is mounted to the suction nozzle assembly body; and an elevating unit for raising and lowering the hair collecting unit, wherein if a front of the suction nozzle assembly body contacts a wall, the elevating unit raises the hair collecting unit, and if the front of the suction nozzle assembly body is separated from the wall, the elevating unit lowers the hair collecting unit to a previous position.

12. The vacuum cleaner as claimed in claim 11, wherein the elevating unit selects one of raising by a vertical movement and raising by a rotational movement in order to adjust the height of the hair collecting unit.

13. The vacuum cleaner as claimed in claim 11, wherein the elevating unit comprises:

a pivot lever that is mounted on the front of the suction nozzle assembly body, and is hingeably rotated by the blocking of a wall; and a supporting device one end of which is connected to the pivot lever and another end of which is connected to the hair collecting unit, and raises and lowers the hair collecting unit in association with the rotational movement of the pivot lever.

14. The vacuum cleaner as claimed in claim 13, wherein the supporting device comprises:

a supporting holder that rotatably supports both ends of the hair collecting unit; and an elevating pin one end of which is connected to the supporting holder and another end of which is connected to the pivot lever.

15. The vacuum cleaner as claimed in claim 14, wherein the supporting holder further comprises a latch unit that blocks the rotational direction of the hair collecting unit.

16. The vacuum cleaner as claimed in claim 15, further comprising an elastic member for pressing the hair collecting unit to contact the surface being cleaned interposed between the supporting device and an inner surface of the suction nozzle assembly body.

17. The vacuum cleaner as claimed in claim 16, wherein the hair collecting unit comprises a hair collecting member having a plurality of protrusions that forms an acute angle with the surface being cleaned so that if the suction nozzle assembly body moves forward, the plurality of protrusions slide on the surface being cleaned, and if the suction nozzle assembly body moves backward, the plurality of protrusions cause friction against the surface being cleaned so as to detach fibrous contaminants.

18. A vacuum cleaner, comprising:

a vacuum cleaner body; and a suction nozzle assembly that is connected to the vacuum cleaner body and draws in dust-laden air from a surface being cleaned, wherein the suction nozzle assembly comprises:

a suction nozzle assembly body that comprises a suction passage on fore part thereof;

a hair collecting drum that is disposed on the fore part of the suction nozzle assembly body and eliminates human or animal hair; and a pivot brush that is rotatably mounted on the rear part of the hair collecting drum; and an elevating unit for raising and lowering the hair collecting drum, wherein if a front of the suction nozzle assembly body contacts a wall, the elevating unit raises the hair collecting unit, and if the suction nozzle assembly body is separated from the wall, the elevating unit lowers the hair collecting unit to a previous position.

19. The vacuum cleaner as claimed in claim 18, wherein the elevating unit comprises:

a pivot lever that is mounted on the fore part of the suction nozzle assembly body, and is hingeably rotated by the blocking of the wall;

a supporting device for the hair collecting drum that supports both ends of the hair collecting drum, wherein an end is connected to the pivot lever and another end is connected to the hair collecting drum so as to raise and lower the hair collecting drum in association with the rotational movement of the pivot lever; and an elastic member that is interposed between the supporting device and an inner surface of the suction nozzle assembly body so as to press the supporting device to contact the surface being cleaned.

20. The vacuum cleaner as claimed in claim 19, wherein the supporting device comprises:

a latch pole that is hinged with the supporting holder for supporting both ends of the hair collecting drum, and restrains the rotational movement of the hair collecting drum; and a latch wheel that is formed inside the supporting holder to correspond to the latch pole and is engaged with the latch pole so that the hair collecting drum rotates in only one direction.

* * * * *